US007249744B2

(12) United States Patent
Bacon et al.

(10) Patent No.: US 7,249,744 B2
(45) Date of Patent: Jul. 31, 2007

(54) QUICK CONNECT MOUNTING SYSTEM FOR A CEILING FAN

(75) Inventors: Ted Bacon, Colliersville, TN (US); Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 262 days.

(21) Appl. No.: 10/682,018

(22) Filed: Oct. 9, 2003

(65) Prior Publication Data

US 2005/0077446 A1 Apr. 14, 2005

(51) Int. Cl.
*B42F 13/00* (2006.01)
*H05K 5/02* (2006.01)

(52) U.S. Cl. ..... 248/343; 248/345; 416/244 R

(58) Field of Classification Search ..... 248/298.1, 248/288.31, 292.12, 292.13, 342, 343, 344, 248/317, 345; 416/244 R
See application file for complete search history.

(56) References Cited

U.S. PATENT DOCUMENTS

| | | | | |
|---|---|---|---|---|
| 1,270,296 | A * | 6/1918 | Jeune | 248/345 |
| 2,749,074 | A | 6/1956 | Bodian | 248/344 |
| 4,245,957 | A | 1/1981 | Savage et al. | 416/135 |
| 4,448,388 | A | 5/1984 | Dennis et al. | 248/663 |
| 4,555,166 | A | 11/1985 | Enomoto | 350/634 |
| 4,729,725 | A | 3/1988 | Markwardt | 417/423 |
| 4,836,806 | A | 6/1989 | Dougherty et al. | 439/751 |
| 4,854,562 | A | 8/1989 | de Fontenay et al. | 267/292 |
| 4,884,947 | A | 12/1989 | Rezek | 416/5 |
| 4,936,533 | A | 6/1990 | Adams et al. | 248/222.1 |
| 5,033,722 | A | 7/1991 | Lammers | 267/153 |
| 5,090,654 | A | 2/1992 | Ridings et al. | 248/343 |
| 5,222,864 | A | 6/1993 | Pearce | 416/5 |
| 5,613,832 | A * | 3/1997 | Su | 416/244 R |
| 6,036,154 | A * | 3/2000 | Pearce | 248/343 |
| 6,234,757 | B1 * | 5/2001 | Pearce | 416/244 R |
| 6,682,036 | B1 * | 1/2004 | Hsu | 248/343 |
| 6,872,054 | B2 * | 3/2005 | Pearce | 416/244 R |

* cited by examiner

*Primary Examiner*—Carl D. Friedman
*Assistant Examiner*—Tan Le
(74) *Attorney, Agent, or Firm*—Baker Donelson

(57) ABSTRACT

A mounting system (10) for supporting a ceiling fan assembly (11) of the type having a motor, motor housing (46), a plurality of blades (47) and a downrod (29) to a ceiling C. The mounting system includes a mounting plate (14) having a plurality of tab locks (21), a mounting bracket having a plurality of locking tabs (37) configured to mate with the tab locks (21). The mounting bracket also has an opening (40) therein configured to receive a ball joint (31) of the downrod (29).

3 Claims, 2 Drawing Sheets

QUICK CONNECT MOUNTING SYSTEM FOR A CEILING FAN

TECHNICAL FIELD

This invention relates to a mounting system for supporting a ceiling fan assembly.

BACKGROUND OF THE INVENTION

Ceiling fans have become an increasingly popular supplementary means of creating an airflow within both commercial and residential buildings. Notwithstanding the widespread use of ceiling fans, the installation of ceiling fans remains problematic.

With conventional mounting systems, the weight of the ceiling fan assembly, which includes the ceiling fan motor, motor housing, downrod, blades and blade irons, is supported by either a mounting bracket or a canopy. These mounting brackets or canopies typically include slotted openings extending from their outer edges to their centers, which are adapted to accept and retain the top end of the downrod which commonly ends in a ball joint.

When a bracket mounting system is used, the slotted mounting bracket is mounted either directly or indirectly to the ceiling at the mounting location of the anticipated connection of the ceiling fan assembly to the electrical current supply. The downrod is positioned within the slotted opening with the ball joint positioned above the slotted opening so that the downrod may be slid along the slotted opening to the mounting bracket's center and then lowered so that the ball nests upon the mounting bracket. Thus, the weight of the ceiling fan assembly is supported by the mounting bracket through the ball joint. The ceiling fan assembly is then wired to the electrical power supply wires within the ceiling. Throughout installation and wiring of the ceiling fan assembly, the canopy rests on or above the ceiling fan motor housing with the downrod extending through the center opening of the canopy. After wiring is completed, the canopy is manually raised along the downrod and is mounted to the mounting bracket to hide the mounting bracket and electrical wires from view.

When a canopy mounting system is used, the canopy is mounted either directly or indirectly to the ceiling at the mounting location of the ceiling fan assembly to the electrical current supply in much the same manner as previously described in reference to the mounting bracket. The downrod is then placed within the slotted opening of the canopy and is slid to the center of the canopy which is adapted to accept and retain the downrod ball joint. Thus, the weight of the ceiling fan assembly is supported by the canopy through the ball joint. Working through the slotted opening in the canopy, the installer wires the ceiling fan assembly to the electrical wires within the ceiling. A cover is then mounted to cover the opening and form a complete canopy.

These conventional mounting systems, however, have permitted the ceiling fan assembly to rotate during installation. As the ceiling fan assembly rotates, the electrical wires become twisted. Twisted wires are apt to break or be damaged and will require repair or replacement.

Additionally, the rotation of the ceiling fan assembly during installation makes wiring the ceiling fan assembly to the electrical wires within the ceiling more difficult. The rotation of the ceiling fan assembly during installation also lengthens the installation time because the installer must repeatedly manually rotate the ceiling fan assembly in a direction opposite to the twisting rotation in order to align the ceiling fan assembly wires with the appropriate electrical power supply wires in the ceiling.

With both bracket mounting systems and conventional canopy mounting systems, additional installation problems are common. For instance, these systems permit the installer only limited physical access through the small slotted opening to wire the ceiling fan assembly to the electrical wires in the ceiling. Furthermore, the bracket and canopy obstructs the installer's visual inspection of the wiring beyond the small slotted canopy opening. With limited physical and visual access to the wiring within the bracket or canopy, there is a noticeable increase in the difficulty of installing the ceiling fan assembly, in the time required for installation, in the possibility that wires will become damaged or broken during installation, and in the probability that the wiring connection will be faulty.

It thus is seen that a need remains for an apparatus for supporting the weight of the ceiling fan assembly and for preventing the rotation of the ceiling fan assembly during installation. Accordingly, it is to the provision of such that the present invention is primarily directed.

SUMMARY OF THE PRESENT INVENTION

In a preferred form of the invention, a mounting system for supporting a ceiling fan assembly of the type having a motor, motor housing, a plurality of blades and a downrod to a support surface. The mounting system comprises a mounting plate adapted to be mounted to a supporting surface and having at least one tab lock, a mounting bracket having one end with at least one locking tab configured to mate with the tab lock and an opposite end adapted to be coupled to the downrod, and a canopy coupled to the downrod of the ceiling fan assembly and adapted to be coupled to the mounting plate or mounting bracket. With this construction, an operator may couple the ceiling fan assembly to the support surface by mounting the mounting plate to the support surface and then simply coupling the mounting bracket to the mounting plate.

DETAILED DESCRIPTION OF THE PREFERRED EMBODIMENTS

Figure 1:
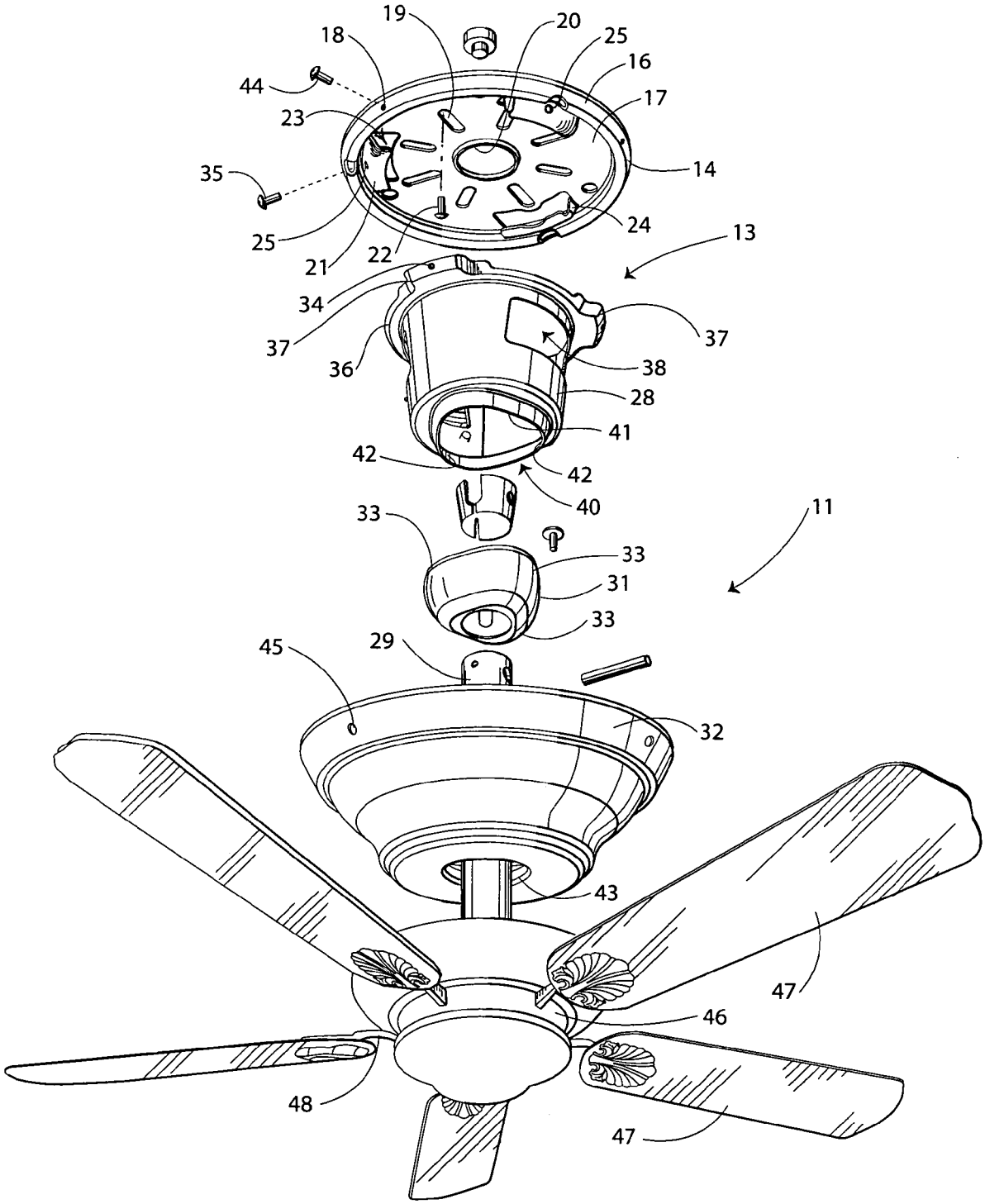
FIG. 1 is a perspective, exploded view of a mounting system apparatus according to the present invention, shown in an unmounted position.

With reference next to the drawings, there is shown a mounting system 10 and conventional ceiling fan assembly 11 in a preferred form of the invention, shown with the mounting system 10 in an enlarged scale for clarity of explanation. The mounting system 10 includes a mounting plate 14 and a lower hanging assembly 13.

The mounting plate 14 has a peripheral, annular flange 16 extending from a generally planar central portion 17. The annular flange 16 has an annular array of three mounting holes 18. The central portion 17 has an annular array of mounting holes 19 therein through which two mounting screws 22 are passed and threaded into a supporting surface such as a ceiling C through a conventional junction box, a central wire opening 20, and three tab locks 21. Each tab lock 21 has an open end 23, a closed end 24 and a screw hole 25.

The lower hanging assembly 13 includes a cup-shaped mounting bracket 28, a downrod 29 coupled to a balljoint 31, and a canopy 32 journalled upon the downrod 29. The downrod 29 has the ball joint 31 fixed to its upper end and the ceiling fan assembly 11 coupled to its lower end. The ball joint 31 is tri-lobed or trilobular in shape and thus includes three integrally formed lobes 33. The mounting bracket 28 has a top edge 36 from which extends three locking tabs 37 sized and shaped to rotatably engage the corresponding tab locks 21 of the mounting plate 14. Each locking tab 37 has a threaded screw mounting hole 34 therein configured to threadably receive a mounting screw 35. The mounting bracket 28 also has a pair of oppositely disposed side access ports 38 and a central, trilobular opening 40, defined by a beveled flange 41 adapted to receive and nest the ball joint 31 therein. The trilobular opening 40 is generally triangular in shape and therefore has three rounded corners or lobe receiving portions 42. Each corner 42 is generally radially aligned with one locking tab 37, as this has been discovered to reduce the amount of fan wobble. The canopy 32 includes a central opening 43 adapted to allow the passage of the downrod 29 therethrough. The lower hanging assembly 13 also includes three screws 44 adapted to extend through three corresponding mounting holes 45 in the canopy 32 and be threadably received within the three corresponding threaded mounting holes 18 in the mounting plate flange 16.

The ceiling fan assembly 11 has an unshown motor, a motor housing 46, fan blades 47, and blade irons 48. The ceiling fan motor extends through an opening at the lower end of the motor housing 46. The ceiling fan blades 47 are coupled to blade irons 48 which are in turn are coupled to the motor at pre-determined locations depending on the desired number of fan blades 47. Although the ceiling fan assembly 11 is shown in the preferred embodiment with five blades 47, any number of fan blades 47 may be used as dictated by convention. Thus, rotational motion produced by the motor will produce air circulation through rotational movement of the fan blades 47. In order to control the speed of rotation of the fan blades 47, the motor has an unshown control switch which can be controlled conventionally through actuation of a pull string or electrical controller.

In use, the mounting plate 14 is mounted to the ceiling C by extending the two screws 22 through the screw holes 19 in the mounting plate 14 and threading the screws 22 into the ceiling C through a conventional junction box or directly to ceiling joists.

Figure 2:
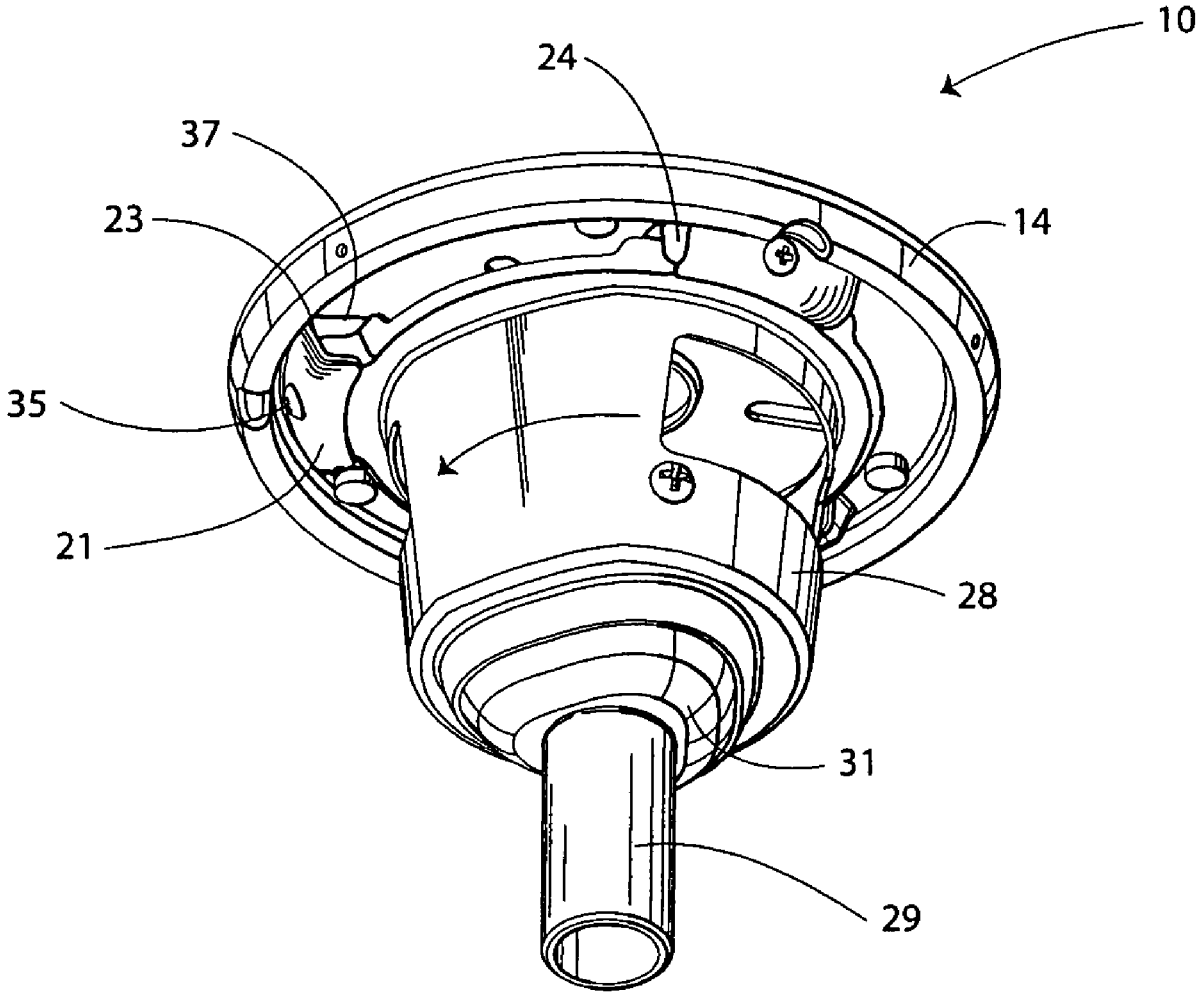
FIG. 2 is a perspective view of the mounting system shown in a mounted.

Prior to coupling the mounting bracket 28 to the mounting plate 14, the trilobular ball joint 31 is nested within the mounting bracket trilobular opening 40 with the canopy 32 journalled upon the downrod 29 in a typical position resting upon the motor housing 46. The lower housing assembly 13 is then raised to a position wherein the mounting bracket locking tabs 37 are positioned adjacent the open end 23 of the mounting plate tab locks 21. The mounting bracket 28 is then rotated, as shown by the arrow in FIG. 2, so that the locking tabs 37 are passed through the open end 23 and continually rotated until they contact the closed end 24, thereby becoming lockably received or registered with the three corresponding tab locks 21, as shown in FIG. 2. Each of the three mounting screws 35 are then passed through the corresponding screw holes 25 in the tab locks 21 and threaded into the screw mounting holes 34 in the locking tabs, thereby preventing the tab locks from accidently disengaging the locking tabs 37.

The ceiling fan assembly 11, specifically the unshown electric wires associated with the electric motor, is then wired to the electrical wires in the ceiling. The ceiling electric wires have already been pulled through the mounting plate wire opening 20 and may be accessed through the mounting bracket access ports 38. It should be noted that the installer may couple the wires without simultaneously lifting the ceiling fan assembly 11 or maintaining the relative position of the ceiling fan assembly 11.

Once the mounting bracket 28 is firmly locked upon the mounting plate 14, the canopy 32 is raised along the downrod 29 to a position wherein the canopy is generally adjacent and surrounding the mounting plate 14. The three threaded screws 44 are then passed through the canopy mounting holes 45 and threaded into the mounting plate screw mounting holes 18, thereby fixing the canopy to the mounting plate.

It should be understood that the present invention allows for an installer to mount the ceiling fan assembly to the mounting plate in a quick and efficient manner. Should the ceiling fan assembly 11 be removed from the ceiling C, the screws 44 are simply unthreaded, the canopy lowered, the electric wires disconnected, and the mounting bracket rotated in the opposite direction to disengage the locking tabs from the tab locks.

It should be understood that as an alternative to the threaded screws 44, the canopy may be configured to be threaded, snap fitted or coupled by other similar means onto the mounting plate. Although the preferred embodiment depicts three tab locks 21 and locking tabs 37, it should be understood that any number of such may be used without departing from the scope of the invention.

It should also be understood that the relative positions of the tab locks and locking tabs may be reversed so that the tab locks 21 extend outwardly from the mounting plate and the locking tabs 37 extend inwardly from the mounting bracket. Obviously, this configuration would necessitate the reconfiguring of the canopy. Also, the canopy may be mounted to the mounting bracket instead of the mounting plate, as the purpose of the canopy is to simply cover these items from view.

It thus is seen that a mounting system for supporting a ceiling fan assembly is now provided. It should be understood that many modifications may be made to the specific preferred embodiment described herein without departure from the spirit and scope of the invention as described by the following claims.

The invention claimed is:

1. A mounting system for supporting a ceiling fan assembly of the type having a motor, a motor housing, a plurality of blades and a downrod, the mounting system comprising;

(a) a mounting plate adapted to be coupled to a supporting surface, said mounting plate having at least one tab lock;

(b) a rotatable mounting bracket having one end with three locking tabs configured to mate rotatably with said tab lock and an opposite end adapted to be coupled to the downrod, said mounting bracket opposite end has a beveled, trilobular opening therein and a trilobular downrod ball joint configured to reside within said beveled opening, and wherein each locking tab is radially aligned with one lobe of said trilobular ball joint; and (c) a canopy adapted to be mounted to said mounting plate, whereby an operator may couple the ceiling fan assembly to a support surface by mounting the mounting plate to the support surface and then simply coupling the mounting bracket to the mounting plate.

2. A mounting system for supporting a ceiling fan assembly of the type having a motor, a motor housing, a plurality of blades and a downrod, the mounting system comprising;

(a) a mounting plate;

(b) a mounting bracket having rotatable locking means for rotatably locking said mounting bracket to said mounting plate, said mounting bracket has an end with a trilobular, beveled opening therein and a trilobular downrod ball joint configured to reside within said beveled opening, said rotatable locking means includes three tab locks and three locking tabs, and wherein each locking tab is radially aligned with one lobe of said trilobular ball joint; and (c) a canopy mounted to said mounting plate and obscuring said mounting bracket, whereby an operator may couple the ceiling fan assembly to a support surface by mounting the mounting plate to the support surface and then simply coupling the mounting bracket to the mounting plate.

3. The mounting system of claim 2 wherein said tab lock extends from said mounting plate and wherein said locking tab extends from said mounting bracket.

* * * * *